US005288418A

United States Patent [19]

Farng et al.

[11] Patent Number: 5,288,418

[45] Date of Patent: Feb. 22, 1994

[54] AMINE-COUPLED HINDERED PHENOLS AND PHOSPHITES AS MULTIFUNCTIONAL ANTIOXIDANT/ANTIWEAR ADDITIVES

[75] Inventors: Liehpao O. Farng, Lawrenceville; Andrew G. Horodysky; William F. Olszewski, both of Cherry Hill, all of N.J.

[73] Assignee: Mobil Oil Corporation, Fairfax, Va.

[21] Appl. No.: 985,043

[22] Filed: Dec. 3, 1992

[51] Int. Cl.[5] ..... C10M 133/00; C10M 137/12

[52] U.S. Cl. ..... 252/49.9; 558/145; 558/166

[58] Field of Search ..... 252/49.9, 32.5; 558/145, 166

[56] References Cited

U.S. PATENT DOCUMENTS

| | | | |
|---|---|---|---|
| 2,304,156 | 12/1942 | Englemann | 252/49.9 |
| 3,268,450 | 8/1966 | Sims et al. | 252/49.9 |
| 3,553,265 | 1/1971 | Maier | 252/49.9 |
| 3,591,501 | 7/1971 | Olszewski et al. | 252/49.9 |
| 4,331,546 | 5/1982 | Frangatos | 252/49.9 |
| 5,059,335 | 10/1991 | Rizvi et al. | 252/47 |

*Primary Examiner*—margaret Medley

*Attorney, Agent, or Firm*—Alexander J. McKillop; Malcolm D. Keen; Howard M. Flournoy

[57] ABSTRACT

Amine coupled condensation products of hindered phenols and phosphites have been found to be effective antioxidant/antiwear additives for lubricants.

12 Claims, No Drawings

AMINE-COUPLED HINDERED PHENOLS AND PHOSPHITES AS MULTIFUNCTIONAL ANTIOXIDANT/ANTIWEAR ADDITIVES

BACKGROUND OF THE INVENTION

1. Field of the Invention

This application is directed to amine coupled hindered phenol and phosphite derivatives useful as multifunctional antioxidant/antiwear lubricant additives and to lubricant compositions comprised thereof.

2. Description of Related Art

The use of hindered phenols, such as 2,6-di-tert-butylphenol and 2,6-di-tert-butyl-para-cresol, has been well known for their thermal/oxidation stabilizing properties in a variety of lubricant, polymer and elastomer applications.

The use of amine derivatives, such as amine phosphate salts, has been widespread for several decades as corrosion inhibitors and antiwear/EP additives.

The use of phosphite (hydrogen phosphonate) compositions, such as dibutyl phosphite and dinonylphenyl phosphite, has also been well known in lubricants as antiwear/EP additives.

It has now been found that the use of these amine coupled condensation products of hindered phenols and phosphites provides exceptional antioxidant and antiwear/EP activity with potential thermal stabilizing and metal chelating properties.

BRIEF SUMMARY OF THE INVENTION

It has been found that lubricant compositions containing small additized amounts of amine coupled condensation products of phenols and phosphites possess excellent antioxidant and metal deactivating activity coupled with very good antiwear/EP load carrying capability. Both the hindered phenol moiety and the phosphite moiety are believed to provide the basis for the synergistic antioxidant and thermal stabilizing activity. The phosphite moiety is believed to contribute additional metal chelating and stabilizing properties of the final structure. Antirust, anti-corrosion, detergency/dispersancy, cleanliness, thermal stability, friction reducing and anti-fatigue properties are expected with many of the disclosed compositions of the instant invention.

All of these beneficial properties are believed to be enhanced as a result of this novel internal synergism. This unique internal synergism concept is believed to be applicable to similar structures containing (a) hindered or semi-hindered phenol groups, (b) phosphite groups, (c) substituted or non-substituted amine or diamine linkage within the same molecule. The products of this invention show good thermal stability and compatibility when used in the presence of other commonly used additives in lubricant compositions.

Since there is a constant and ongoing need for improved and better additized products in the lubricant art, it is therefore an object of this invention to provide improved lubricant compositions comprising the aforementioned multifunctional additive reaction products. Accordingly, this invention is directed to lubricant compositions comprising a major amount of an oil of lubricating viscosity and a minor multifunctional amount of the hereindescribed amine coupled condensation products of hindered phenols and phosphites as well as to said condensation products.

DESCRIPTION OF PREFERRED EMBODIMENTS

Alkylated phenol (hindered or semi-hindered) was reacted with an aldehyde (or ketone), and aliphatic primary or secondary amines or diamines to form condensation products. These condensation products were subsequently reacted with aldehyde (or ketone), and dihydrocarbyl phosphites to form the amine coupled phenol-phosphite adducts as described in Equation 1. The exact structures of the adducts so produced are not known. A mixture of adducts or compounds having various structures may be formed. One possible structure is shown in Equation 1 below.

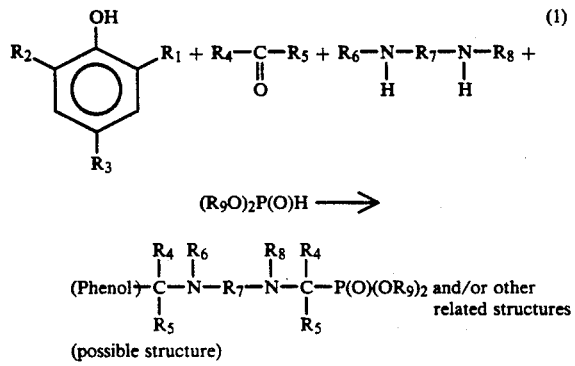

Where $R_1$, $R_2$, $R_3$, $R_6$ and $R_8$ are hydrogen or $C_1$ to $C_{60}$ hydrocarbyl, or oxygen, nitrogen, sulfur containing $C_1$ to $C_{60}$ hydrocarbyl; but both $R_1$ and $R_2$ cannot be hydrogen, and at least one of the $R_1$, $R_2$ and $R_3$ shall be a hydrogen. $R_4$ and $R_5$ are hydrogen or $C_1$ to $C_{30}$ hydrocarbyl, $R_7$ and $R_9$ are $C_1$ to $C_{60}$ hydrocarbyl.

In accordance with Equation 1, all of the reactants may be simultaneously reacted, i.e., the alkylated phenol, the aldehyde or ketone, the amine and the hydrocarbyl phosphite may be reacted in a one-step batch, a multi-step batch or multi-step continuous process.

Suitable amines include but are not limited to the following: diethylenetriamine, triethylenetetramine tetraethylenepentamine, polyoxyalkylenediamines (Jeffamine D series, ED series), polyoxyalkylenetriamines (Jeffamine T-series), N-alkyl-1,3-diaminopropane, etc. or mixtures of such amines. A preferred amine is ethylenediamine.

Suitable hindered or semi-hindered alkylated phenols include but are not limited to the following: 2,4-di-tert-butylphenol, 2-tert-butylphenol, 2,6-di-tert-butylphenol, 2,4-di-sec-butylphenol 2-sec-butylphenol, 2-methylphenol, etc. or mixtures of such phenols. A preferred phenol is 2,6-di-tert-butylphenol. 2,6-di-tert-butylphenol is as defined herein a hindered phenol because both the 2 and the 6 position contain functional groups. A semi-hindered phenol would then be a phenol where, for example, only the 2 or the 6 position would contain a functional group, e.g., 2-tert-butyl phenol.

Suitable aldehydes or ketones include but are not limited to the following: methylethylketone (2-butanone), acetone, butyraldehyde, 2-ethylhexanal, formaldehyde, etc. Paraformaldehyde is a preferred carbonyl coupling agent.

Conditions for the above reactions may vary widely depending upon specific reactants, the presence or absence of a solvent and the like. Any suitable set of reaction conditions known to the art may be used. Generally stoichiometric quantities of reactants are used. However, equimolar, more than molar or less than molar amounts may be used. More specifically an excess of one reagent or another can be used and molar quantities, less than molar quantities or more than molar quantities of phosphite, phenol, amine or carbonyl coupling agent can be used. The reaction temperature may vary from ambient to about 250° C. or reflux, the pressure may vary from ambient or autogenous to about 1000 psi. The molar ratios of reactants preferably varies from about 0.01 moles to about 100 moles, i.e., (1) alkylated phenol to (2) aldehyde or ketone (carbonyl coupling agent) to (3) amine to (4) hydrocarbyl phosphite may vary from about 1:1:0.5:1 to about 0.01-100:0.01-100:0.5-50:0.-01-100.

Any suitable hydrocarbon solvent such as toluene, hexane or a xylene may be used if desired.

The additives embodied herein are utilized in lubricating oil or grease compositions in an amount which imparts significant antiwear characteristics to the oil or grease as well as reducing the friction of engines operating with the oil in its crankcase. Suitable additive concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers and phenoxy phenylethers.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, nonmetallic or metallic phosphorodithioates and the like. These materials do not detract from the value of the compositions of this invention, rather the materials serve to impart their customary properties to the particular compositions in which they are incorporated.

The following examples are merely illustrative and are not meant to be limitations.

EXAMPLE 1

Approximately 62.0 g (0.3 mole) of 2,6-di-tert-butylphenol, 25.0 g (0.308 mole) of paraformaldehyde, 9.0 (0.15 mole) of ethylenediamine, and 150 ml of hexane were added into a suitably equipped 500 ml four-necked flask. This reaction mixture was then heated to the boiling temperature of hexane and was refluxed over a course of three hours, and the water which formed was collected in a Dean-Stark trap. Then it was cooled to ambient temperature and reacted with 91.9 g (0.3 mole) of bis(2-ethylhexyl) phosphite and 25.0 g 0.308 mole) of paraformaldehyde. Again, it was heated to the boiling temperature of hexane and was refluxed for three hours while azeotropically removing water. Finally, the reactants were heated at 110° C. to remove all the volatiles via distillation to produce approximately 179.3 g of a viscous material.

The amine coupled phosphite-phenol product was blended into mineral oils and evaluated for antioxidant performance using the Catalytic Oxidation Test at 325° F. for 40 hours, and the Catalytic Oxidation Test at 325° F. for 72 hours (Table 1).

The Catalytic Oxidation Test consists basically of bubbling a stream of air through a volume of the lubricant at the rate of five liters per hour respectively at 325° F. for 40 hours and 72 hours. See U.S. Pat. No. 3,682,980 incorporated herein by reference for further details.

TABLE 1

| Item | Catalytic Oxidation Test 325° F., 40 hours % Change in Visc. ΔKV, % | Change in Acid No. ΔTAN | Sludge | 325° F., 72 hours % Change in Visc. ΔKV, % | Change in Acid No. ΔTAN | Sludge |
|---|---|---|---|---|---|---|
| Base oil (200 second, solvent refined paraffinic neutral oil) | 57.9 | 4.78 | Heavy | 99.4 | 8.53 | Heavy |
| 1% of Ex. 1 in above base oil | 31.6 | 4.60 | Heavy | 26.8 | 4.61 | Heavy |

As shown above, the products of this invention show considerable antioxidant activity a evidenced by the control of viscosity and acidity increase.

The amine coupled phenol-phosphite product was also blended into mixed mineral oils and evaluated for antiwear performance using the Four-Ball Wear test (Table 2). As can be seen from the data in Table 2, this product exhibits significant antiwear activities.

The Four-Ball Wear Test was performed in accordance with ASTM D-2266. See U.S. Pat. No. 4,761,482, incorporated herein by reference, for further details.

* Wear Coefficient $K$
Dimensionless $K$ is defined as $$K = \frac{VH}{dW} \text{ where}$$

$V =$ volume, $mm^3$ $H =$ hardness (725 $kg/mm^2$ for 52100 steel)

$d =$ (23.3 mm/rev) (RPM × time)

$W =$ (0.408) (Load in kg)

The wear volume V will be calculated from the wear scar diameter D in mm as follows:

$$V=[15.5D^3-0.0103L]D\times 10^{-3}mm^3$$

where L is the machine load in kg. This equation considers the elastic deformation of the steel balls. For 60 kg load, the equation is $$V=[15.5\ D^3-0.618]D\times 10^{-3}mm^3$$

TABLE 2

| Examples | Four-Ball Wear Test (2000 rpm, 60 kg load, 30 min., 200° F.) Wear Scar Diameter (mm) | Wear Coefficient* K(×10⁻⁸) |
|---|---|---|
| Base oil (80% solvent paraffinic bright, 20% solvent paraffinic neutral mineral oils) | 3.745 | 6453 |
| 1% of Ex. 1 in above base oil | 0.428 | 0.5 |

This product was also blended into fully formulated engine oils and evaluated for load-carrying performance using the Four-Ball EP test (Table 3 (ASTM D-2783) which measures the extreme pressure characteristics or load-carrying properties of a lubricant by a Load Wear Index (LWI) and a Weld point. A test ball is rotated under load at a tetrahedral position on top of three stationary balls immersed in lubricant. Measurements of scars on the three stationary balls are used to calculate LWI's (load wear index), and the weld is the load at which the four balls weld together in 10 seconds. The last non-seizure load is the last load at which the measured scar diameter is not more than 5% above the compensation line at the load. The compensation line is a logarithmic plot where the coordinates are scar diameter in millimeters and applied load in kilograms obtained under dynamic conditions. The higher the LWI value the better.

TABLE 3

| | Four-Ball EP Test (1760 rpm, 10 sec., 25° C.) Last Non-Seizure Load (kg) | Weld Load (kg) | Load Wear Index (LWI) |
|---|---|---|---|
| Base oil (700 sus fully formulated solvent refined paraffinic neutral oil containing anticorrosion/antioxidant/antiwear performance package) | 100 | 250 | 44.1 |
| Base oil plus 0.25% additional commercial EP additive (Anglamol 33) | 100 | 250 | 46.8 |
| Base oil plus 0.5% of Ex. 1 | 126 | 250 | 51.9 |

As shown above, the products of this invention demonstrate considerable EP activity as evidenced by the improvement of the Load Wear Index and the microseizure load.

Although these products have demonstrated significant antiwear/antioxidant activity, they are extremely non-corrosive to metals such as copper alloys, as evidenced by the copper strip corrosivity performance (Table 4).

The Copper Strip Corrosivity Test (ASTM D-130) measures a product's propensity to corrode copper due to, for example, contained sulfur groups. Further details may be found in ASTM Standards on Petroleum Products and Lubricants, published annually by the American Society for testing Materials.

TABLE 4

| Item | Copper Strip Corrosivity (250° F., 3 Hours) Corrosivity Rating |
|---|---|
| Base oil (200 second, solvent refined, paraffinic neutral mineral oil) | 1A |
| 1% of Example 1 in above base oil | 1A |

The use of additive concentrations of amine coupled phosphite-phenol products in premium quality automotive and industrial lubricants will significantly enhance the stability and load carrying capacity, and reduce the wear. These novel compositions described in this patent application are useful at low concentrations and do not contain any potentially undesirable metals, or chlorine.

What is claimed is:

1. A lubricant composition comprising a major proportion of an oil of lubricating viscosity or grease prepared therefrom and a minor amount of a multifunctional antiwear/antioxidant additive product of reaction prepared by (a) reacting a hindered or semi-hindered alkylated phenol with an aldehyde or ketone and an aliphatic primary or secondary amines or diamine to form condensation products and (b) subsequently reacting said condensation products with an aldehyde or ketone and a hydrocarbyl phosphite to form amine coupled phenol-phosphite adducts and wherein the reaction is carried out at temperatures varying from ambient to about 250° C. under ambient up to 1000 psi or autogenous pressures for a time sufficient to obtain the desired amine coupled phenol-phosphite additive product of reaction and wherein the reaction is carried out in molar ratios of reactants varying from equimolar to more than molar to less than molar.

2. The composition of claim 1 wherein said amine coupled phenol-phosphite has the following structure:

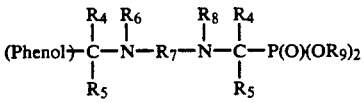

wherein $R_4$ and $R_5$ are $C_1$ to about $C_{30}$ hydrocarbyl, $R_6$ and $R_8$ are hydrogen H optionally $C_1$ to about $C_{60}$ hydrocarbyl or $C_1$ to about $C_{60}$ hydrocarbyl containing O, N, or S, and $R_7$ and $R_9$ are $C_1$ to about $C_{60}$ hydrocarbyl.

3. The composition of claim 1 wherein the reactants are 2,6-di-tert-butylphenol, paraformaldehyde, ethylenediamine and bis(2-ethylhexyl) phosphite.

4. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1), (2) or (3).

5. The composition of claim 1 wherein the lubricant contains from about 0.001 to about 10 wt% based on the total weight of the composition of the additive product of reaction.

6. The composition of claim 4 wherein the lubricant is a mineral oil.

7. A process of preparing a multifunctional antioxidant, antiwear additive product prepared by (a) reacting a hindered or semi-hindered alkylated phenol with an aldehyde or ketone and aliphatic primary or secondary amines or diamines to form condensation products and (b) subsequently reacting said condensation products with an aldehyde or ketone and a hydrocarbyl phosphite to form amine coupled phenol-phosphite adducts wherein the reaction is carried out at temperatures varying from ambient to about 250° C. under ambient or autogenous pressures for a time sufficient to obtain the desired additive product of reaction and wherein the reaction is carried out in molar ratios of reactants varying from equimolar to more than molar to less than molar.

8. The process of claim 7 wherein the reactants are 2,6-di-tert-butylphenol, paraformaldehyde, ethylenediamine and bis(2-ethylhexyl) phosphite.

9. A multifunctional antiwear/antioxidant lubricant additive product of reaction prepared by (a) reacting a hindered or semi-hindered alkylated phenol with an aldehyde or ketone and aliphatic primary or secondary amines or diamines to form condensation products and (b) subsequently reacting said condensation products with an aldehyde or ketone and a hydrocarbyl phosphite to form amine coupled phenol-phosphite adducts wherein the reaction is carried out at temperatures varying from ambient to about 250° C. under ambient to about 1000 psi or autogenous pressures for a time sufficient to obtain the desired additive product of reaction and wherein the reaction is carried out in molar ratios of reactants varying from equimolar to more than molar to less than molar.

10. An additive product of reaction of claim 9 comprising amine coupled phenol-phosphite adducts wherein the reactants in reaction (a) are 2,6-di-tert-butyl phenol, paraformaldehyde and ethylenediamine and in reaction (b) said reactants are bis(2-ethylhexyl)phosphite and paraformaldehyde.

11. The multifunctional antiwear/antioxidant lubricant additive product of reaction of claim 10 having the following structure:

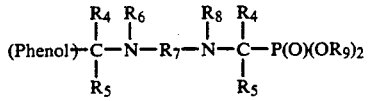

where $R_4$ and $R_5$ are hydrogen or $C_1$ to about $C_{30}$ hydrocarbyl, $R_6$ and $R_8$ are hydrogen, $C_1$ to about $C_{60}$ hydrocarbyl, or optionally $C_1$ to about $C_{60}$ hydrocarbyl containing oxygen, nitrogen or sulfur and $R_7$ and $R_9$ are $C_1$ to about $C_{60}$ hydrocarbyl.

12. A method of preparing an improved lubricant composition comprising adding to said lubricant a minor multifunctional antiwear/antioxidant amount of from about 0.001 to about 10 wt% based on the total weight of the composition of an additive product of reaction as described in claim 9.

* * * * *